US006155547A

United States Patent [19]

Gatanas

[11] Patent Number: 6,155,547

[45] Date of Patent: Dec. 5, 2000

[54] STUD CLAMP

[76] Inventor: Louie Gatanas, 46-35 159th St., Flushing, N.Y. 11358

[21] Appl. No.: 09/237,933

[22] Filed: Jan. 27, 1999

[51] Int. Cl.[7] ..... B25B 5/14

[52] U.S. Cl. ..... 269/6; 269/41; 269/904

[58] Field of Search ..... 269/3, 6, 41, 155, 269/159, 239, 228, 904, 315

[56] References Cited

U.S. PATENT DOCUMENTS

| | | | |
|---|---|---|---|
| 3,357,464 | 12/1967 | Vroman | 269/41 |
| 4,165,869 | 8/1979 | Williams | 269/41 |
| 4,505,011 | 3/1985 | Dupuy | 269/41 |
| 5,192,060 | 3/1993 | Novak | 269/155 |
| 5,364,084 | 11/1994 | Karash | 269/41 |
| 5,575,518 | 11/1996 | Payne | 269/41 |

*Primary Examiner*—Robert C. Watson
*Attorney, Agent, or Firm*—Breiner & Breiner

[57] ABSTRACT

A stud clamp is provided that attaches across a first stud providing a stationary brace for a second perpendicular stud to be connected to the first, thereby facilitating the toe-nailing process. The stud clamp is adjustable to fit variety of stud widths and has a clamping mechanism for securely clamping the device to the first stud.

4 Claims, 1 Drawing Sheet

10
12
14
20
21
22
23
26
27
28
29
30
32
33
34
35
36
37
38
40
42
50
52
54
56
58
60
62
2
3

STUD CLAMP

FIELD OF INVENTION

The present invention relates to a carpenter's stud clamp for facilitating the activity known as toe-nailing. More particularly, the present invention relates to a stud clamp that adjusts to accommodate studs of various widths and that securely clamps onto the stud during use.

BACKGROUND OF THE INVENTION

Toe-nailing is a construction process in which a horizontal wooden stud, called the "toe-plate", is connected to a vertical wooden stud by nails driven obliquely through both. The procedure produces a sturdy perpendicular connection between studs and is used in structural framing of buildings and in other settings such as window and door framing.

Traditionally, a carpenter joins the two studs by first placing one foot on top of the toe-plate, keeping it snug against one side of the bottom of the unattached vertical stud. The foot acts to steady the vertical stud as the carpenter drives nails downward at an angle, about one inch from the joint, through the vertical stud and into the toe-plate. Thus, the term "toe-nailing". This method, simple as it seems, can take years to master. Keeping one's foot firmly in place while hammering at an angle low to the ground proves challenging for many.

One problem with traditional toe-nailing is that of securely positioning the vertical stud with respect to the toe-plate. In driving a nail at an angle to the studs, the vertical stud has a tendency to move out of position. This is because it is difficult to simultaneously steady the vertical stud with a foot and drive nails at an angle to connect the toe-plate. For this reason, successful toe-nailing often requires the vertical stud to be cut to a perfect length allowing it to be wedged between the toe-plate and an upper horizontal stud. This fit assists the carpenter by holding the vertical stud in place during toe-nailing. However, an imperfect stud length results in either bowing of the stud between the toe-plate and the upper horizontal stud or a loose fit which provides no assistance to the carpenter.

U.S. Pat. No. 5,364,084 discloses a carpenter's toe-nail backup clamp that is cam operated. However, this device has drawbacks, including its inability to accommodate toe-plates of various widths and its lack of an adequate clamping mechanism for securing the device to a toe-plate.

Accordingly, the prior art methods of toe-nailing have proved difficult and cumbersome. The present invention provides a device that solves these problems, making toe-nailing easier, faster, and safer.

SUMMARY OF THE INVENTION

A primary object of the present invention is to provide a stud clamp that facilitates and simplifies toe-nailing.

Another primary object of the invention is to provide a stud clamp that facilitates toe-nailing by providing a secure means for positioning a vertical stud on a toe-plate, eliminating the need for a carpenter's foot to position and hold the stud.

Another object of the invention is to provide a versatile stud clamp that is adjustable to fit a variety of toe-plate widths, for example, 2×3, 2×4, and 2×6 stock.

Another object of the invention is to provide a versatile stud clamp that is effective in any instance where studs need to be joined perpendicularly, including window framing, door framing, as well as the more common large-scale structural framing.

Another object of the invention is to provide a stud clamp having a clamping mechanism that securely clamps the stud clamp to a toe-plate.

Another object of the invention is to provide a stud clamp that is durable, safe, and easy to use.

Another object of the invention is to provide a stud clamp that works well for both right- and left-handed users.

In accordance with these objectives, an adjustable stud clamp used for positioning a vertical stud on a horizontal toe-plate is provided. The stud clamp clamps to a toe-plate across its width to provide a rigid brace that aids the user in stably positioning a vertical stud perpendicular to the toe-plate. The clamp operates to brace the vertical stud against slippage along two axes by preventing the vertical stud from slipping off the side of the toe-plate and from slipping along the toe-plate length.

The stud clamp of the present invention comprises a clamp base and an adjustable clamping mechanism connected to the clamp base.

The clamp base has a horizontal plate attached to a vertical side plate that extends normal to the horizontal plate above and below its bottom surface. The clamp base fits atop a horizontal toe-plate such that the horizontal plate bottom surface rests on the toe-plate across its width and the side plate hangs vertically downward, abutting a vertical edge of the toe-plate. In this position, the clamping mechanism can be activated to hold the stud clamp in place.

The adjustable clamping mechanism is attached to the clamp base horizontal plate. It preferably comprises a vice-grip assembly controlling a pivoting arm that extends below the horizontal plate to a clamping head that is parallel to and opposes the side plate. The head position is adjustable relative to the side plate and capable of sandwiching toe-plates of various widths between the clamping head and the side plate.

In order to accommodate a range of toe-plate widths, in addition to the arm adjustability, the clamping mechanism is preferably attachable to the clamp base at at least two positions on the clamp base horizontal plate.

In operation, the user places the clamp base across a toe-plate with the clamp base side plate abutting a toe-plate vertical edge. The clamping mechanism is then activated to clamp the clamping head against the opposite toe-plate vertical edge. Once the stud clamp is secured, the clamp base horizontal and side plates each serves a bracing function for an unattached vertical stud placed on the toe-plate. The horizontal plate prevents the vertical stud from slipping away from the user along the toe-plate length. The clamp base side plate, with part of its vertical surface extending above the level of the toe-plate top surface, prevents the vertical stud from sliding off the side of the toe-plate.

DESCRIPTION OF THE PRESENTLY PREFERRED EMBODIMENT

Figures 1, 2, 3, 4:
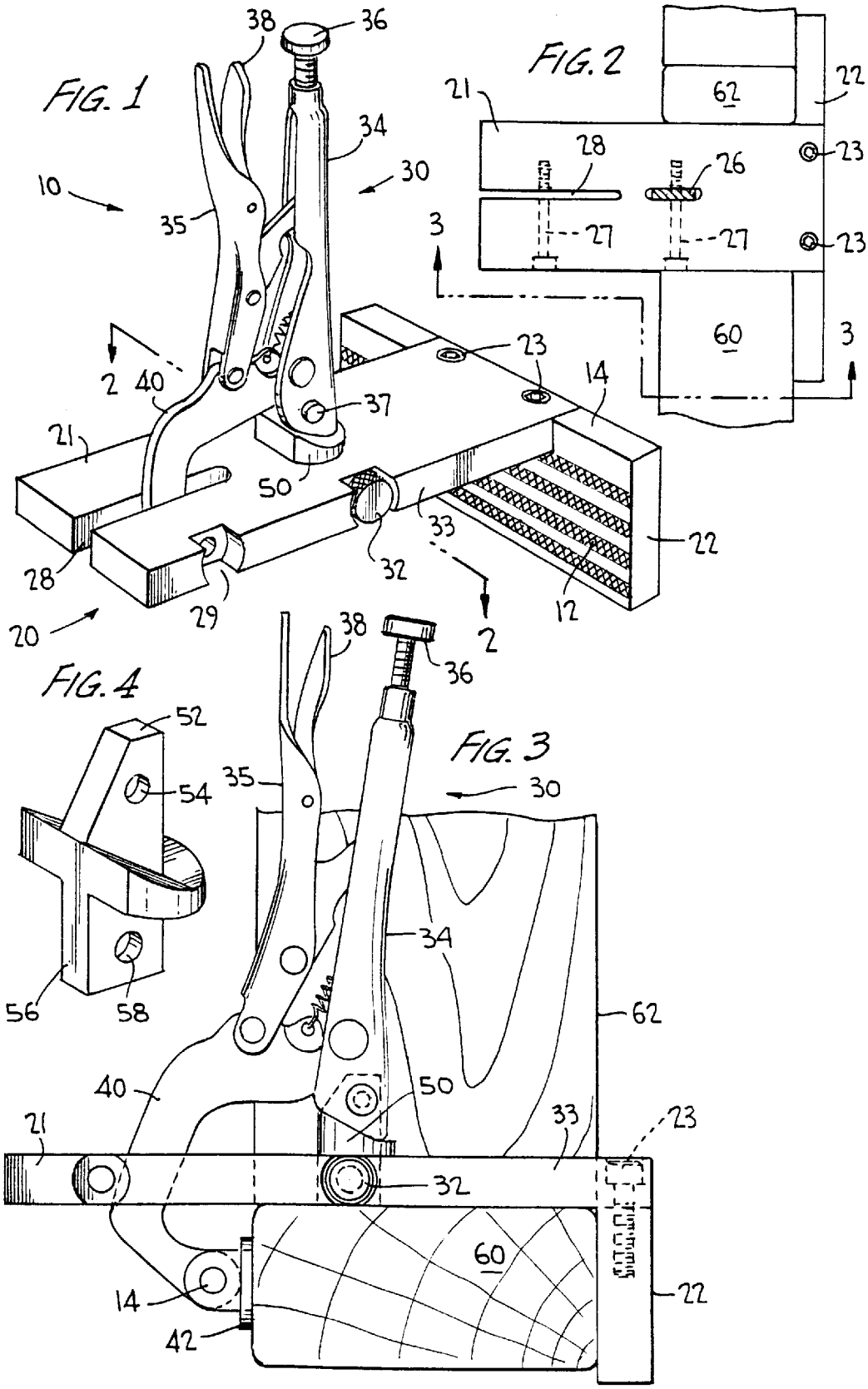
FIG. 1 shows a plan view of a stud clamp according to the present invention.
FIG. 2 shows a top view of the stud clamp, viewed along line 2—2 in FIG. 1, positioned across a toe-plate in relation to a vertical stud.
FIG. 3 shows the stud clamp, toe-plate, and vertical stud as viewed along line 3-3 in FIG. 2.
FIG. 4 shows an adapter piece for attaching the clamping mechanism to the clamp base.

Having described the invention in general terms, a further description of the presently preferred embodiment is provided with reference to the drawings.

Referring to FIG. 1, a stud clamp 10 according to the present invention is shown having clamp base 20 and adjustable clamping mechanism 30.

Clamp base 20 includes horizontal plate 21 and side plate 22. Side plate 22 is a generally rectangular aluminum plate, 5"×2"×½", having knurled sidewall 12 and top wall 14. Top wall 14 includes a 2"×½"×½" central cut-out for receiving horizontal plate 21.

Horizontal plate 21 is a generally rectangular aluminum plate, 6"×2"×½", attached at one end to top wall 14 by allen screws 23 or by any other suitable fastening means. It is understood that the clamp base may also be manufactured from a single piece of material, which may be aluminum or any other suitable material.

The attached combination of horizontal plate 21 and side plate 22 form a right angle between sidewall 12 and horizontal plate 21. Thus, sidewall 12 can be placed against the vertical edge of a toe-plate, with horizontal plate 21 extending across the toe-plate width and resting on the toe-plate upper horizontal surface. The uppermost portion of sidewall 12 extends above the toe-plate.

Adjustable clamping mechanism 30 comprises a vise-grip assembly including pivoting arm 40 connected to handle 34 and locking lever 35. Pivoting arm 40 includes a flat clamping head 42, as shown in FIG. 3. Clamping head 42 is generally rectangular in structure and has a knurled surface to prevent slippage when clamped to a toe-plate. Clamping head 42 is connected to arm 40 by rivet 41. Clamping mechanism handle 34 is attached to clamp base 20 via adapter 50 and removable threaded locking pin 32.

Referring now to FIG. 2, a top view of stud clamp 10 along line 2—2 in FIG. 1 and toe-plate 60 in relation to vertical stud 62 is shown. Pinholes 27 and 29 offer alternative attachment sites for clamping mechanism 30. Proximal slot 26 receives adapter 50 to be secured by locking pin 32 through pinhole 27, located about 2¼" from side plate 22. Distal slot 28 accommodates clamping arm 40. Distal slot 28 can also receive adapter 50, to be secured by locking pin 32 through pinhole 29, located about 4¼" from side plate 22. It is understood that a variety of attachment means for adjustable clamping mechanism 30 are available. The pinhole/locking pin arrangement is preferred for reasons of economy and simplicity.

In FIG. 1, the stud clamp is shown with clamping mechanism 30 attached at proximal slot 26. Rivet 37 attaches adapter 50 to handle 34 of clamping mechanism 30 and is inserted in slot 26. Threaded locking pin 32 is in pinhole 27, immobilizing clamping mechanism 30 on horizontal plate 21. Note that locking pin 32 is flush with vertical bracing wall 33 of horizontal plate 21 and that pinholes 27 and 29 are cut to allow finger access to locking pin 32.

Referring to FIG. 4, adapter 50 is shown. Upper extension 52 has rivet hole 54 for attachment to handle 34. Lower extension 56 fits into either slot 26 or 28 and has hole 58 to receive locking pin 32.

Referring now to FIG. 2 and FIG. 3, the stud clamp 10 is shown in relation to toe-plate 60 and vertical stud 62. Clamping mechanism 30 is a vise-grip adjustable clamping mechanism having handle 34, locking lever 35, adjustment knob 36, and release lever 38. Clamping arm 40 extends through slot 28 beneath horizontal plate 21 and has pivoting clamp head 42. clamping mechanism 30 is adjustable at knob 36 to change the resting position of clamp head 42 relative to side plate 22. It is understood that the clamping mechanism need not comprise the preferred vise-grip assembly, but may be substituted with other types of clamps.

Once adjusted at adjustment knob 36 and/or between alternative pinhole positions, the clamping mechanism is engaged by pulling locking lever 35 toward handle 34. Stud clamp 10 will be securely attached to the toe-plate.

Bracing wall 33 and the uppermost portion of sidewall 12 now serve as braces for positioning unattached vertical stud 62. The "T" shaped profile of the stud clamp, as seen in FIG. 2, illustrates the two axes of bracing provided by the stud clamp. The base of the vertical stud fits a corner that prevents it from moving off the toe-plate and from sliding along its length. The "T" shape also prevents the stud clamp from pivoting on the toe-plate. Note also that sidewall 12, seen in FIG. 1, is knurled to prevent slippage of stud clamp 10 along the toe-plate length.

The combined adjustability provided by the vise-grip adjustment knob and the alternative pinhole attachment points makes the stud clamp of the present invention quite versatile and the vise-grip assembly provides sturdy clamping power. Many variations of the invention are possible in keeping with the principle of stud clamp adjustability. The dimensions of the stud clamp can be adjusted to reach a desired combination of portability, economy, and effectiveness. Additionally, the clamping mechanism may be attached to the clamp base in any suitable fashion that allows adjustability and the structure of the clamping mechanism itself is not limited to a vise-grip assembly, but may comprise any effective type of clamp.

The stud clamp of the present invention may be used in a variety of settings, including those that require the stud clamp to be attached to a vertical rather than a horizontal stud.

While the preferred embodiment of the invention has been described in detail above, various modifications and variations are possible in light of the above teachings. It is therefore to be understood that within the scope of the appended claims, the invention may be practiced other than as described above.

It is claimed:

1. A stud clamp comprising:

a clamp base having a horizontal plate and a vertical side plate;

said horizontal plate having upper and lower horizontal surfaces and vertical bracing walls;

said side plate having a sidewall;

said side plate being connected to said horizontal plate such that said sidewall extends above and below said lower horizontal surface and forms a right angle to said lower horizontal surface;

a clamping mechanism attached to said clamp base including an arm extending to a distal end below said horizontal plate and said clamping mechanism being movable between more than one position on said clamp base;

said arm having a clamping head attached to said distal end;

said clamping head being substantially parallel to and opposing said sidewall;

said clamping head being movable relative to said side plate so as to clamp a first stud between said sidewall and said clamping head; and said vertical bracing walls and sidewall providing a secure brace for a second stud placed normal to said first stud.

2. The stud clamp of claim 1, wherein said clamping mechanism further comprises an adjustable vise-grip assembly having a handle attached to said horizontal plate at said upper surface; said arm being pivotably attached to said handle and controlled by a locking lever; and said clamping head being pivotably affixed to said distal end of said arm.

3. The stud clamp of claim 2, wherein said horizontal plate has a central slot for receiving said arm.

4. A stud clamp comprising;

a horizontal plate having upper and lower horizontal surfaces and vertical bracing walls;

a side plate having a vertical sidewall;

said side plate being affixed to said horizontal plate such that said sidewall extends below said lower horizontal surface and forms a right angle to said lower surface;

adjustable clamping means attached to said upper surface, wherein said clamping means is movable to more than one attachment position on said upper surface.

* * * * *